US007670104B2

(12) United States Patent
Geiger et al.

(10) Patent No.: US 7,670,104 B2
(45) Date of Patent: Mar. 2, 2010

(54) FAN WITH LAMINAR FLOW ELEMENT IN FRONT OF THE SUCTION HOLE

(75) Inventors: Martin Geiger, Bogen (DE); Rudolph Tungl, Ergolding (DE); Reinhold Hopfensperger, Kröning-Magersdorf (DE)

(73) Assignee: EBM-Papst Landshut GmbH, Landshut (DE)

( * ) Notice: Subject to any disclaimer, the term of this patent is extended or adjusted under 35 U.S.C. 154(b) by 841 days.

(21) Appl. No.: 10/576,399

(22) PCT Filed: Sep. 24, 2004

(86) PCT No.: PCT/EP2004/010728

§ 371 (c)(1),
(2), (4) Date: Sep. 12, 2006

(87) PCT Pub. No.: WO2005/050025

PCT Pub. Date: Jun. 2, 2005

(65) Prior Publication Data

US 2007/0066209 A1 Mar. 22, 2007

(30) Foreign Application Priority Data

Oct. 23, 2003 (DE) ..... 103 49 344

(51) Int. Cl.
*F04D 29/00* (2006.01)

(52) U.S. Cl. ..... 415/116; 415/118; 415/144; 431/89

(58) Field of Classification Search ..... 415/116, 415/118, 144, 145, 183, 185, 208.1, 208.2; 431/89

See application file for complete search history.

(56) References Cited

U.S. PATENT DOCUMENTS

| | | | | |
|---|---|---|---|---|
| 2,129,468 | A * | 9/1938 | Heck | 415/116 |
| 2,169,232 | A * | 8/1939 | Flanders | 415/183 |
| 2,690,293 | A * | 9/1954 | Muhlberg | 415/116 |
| 3,625,629 | A | 12/1971 | Morrison et al. | |
| 2004/0106078 | A1 | 6/2004 | Goebel | |

FOREIGN PATENT DOCUMENTS

| | | | |
|---|---|---|---|
| DE | 10017808 | A1 | 6/2001 |
| WO | WO-90/10180 | A1 | 9/1990 |
| WO | WO-2004/070283 | A1 | 8/2004 |

OTHER PUBLICATIONS

International Preliminary Examination Report for PCT/EP2004/010728, dated Sep. 21, 2006.*

* cited by examiner

*Primary Examiner*—Christopher Verdier
(74) *Attorney, Agent, or Firm*—Harness, Dickey & Pierce, PLC

(57) ABSTRACT

A radial fan (1) with a housing (2) and a fan impeller (3) disposed therein, an air inlet (4) and an air outlet (5) is provided, a pressure space (6) being formed between the latter, and in front of the air inlet (4) a laminar element (7) being disposed which, in a bypass (8) formed therein, has a sensor (9) for recording at least one parameter of the medium flowing through the air inlet (4).

13 Claims, 3 Drawing Sheets

Figure 1:
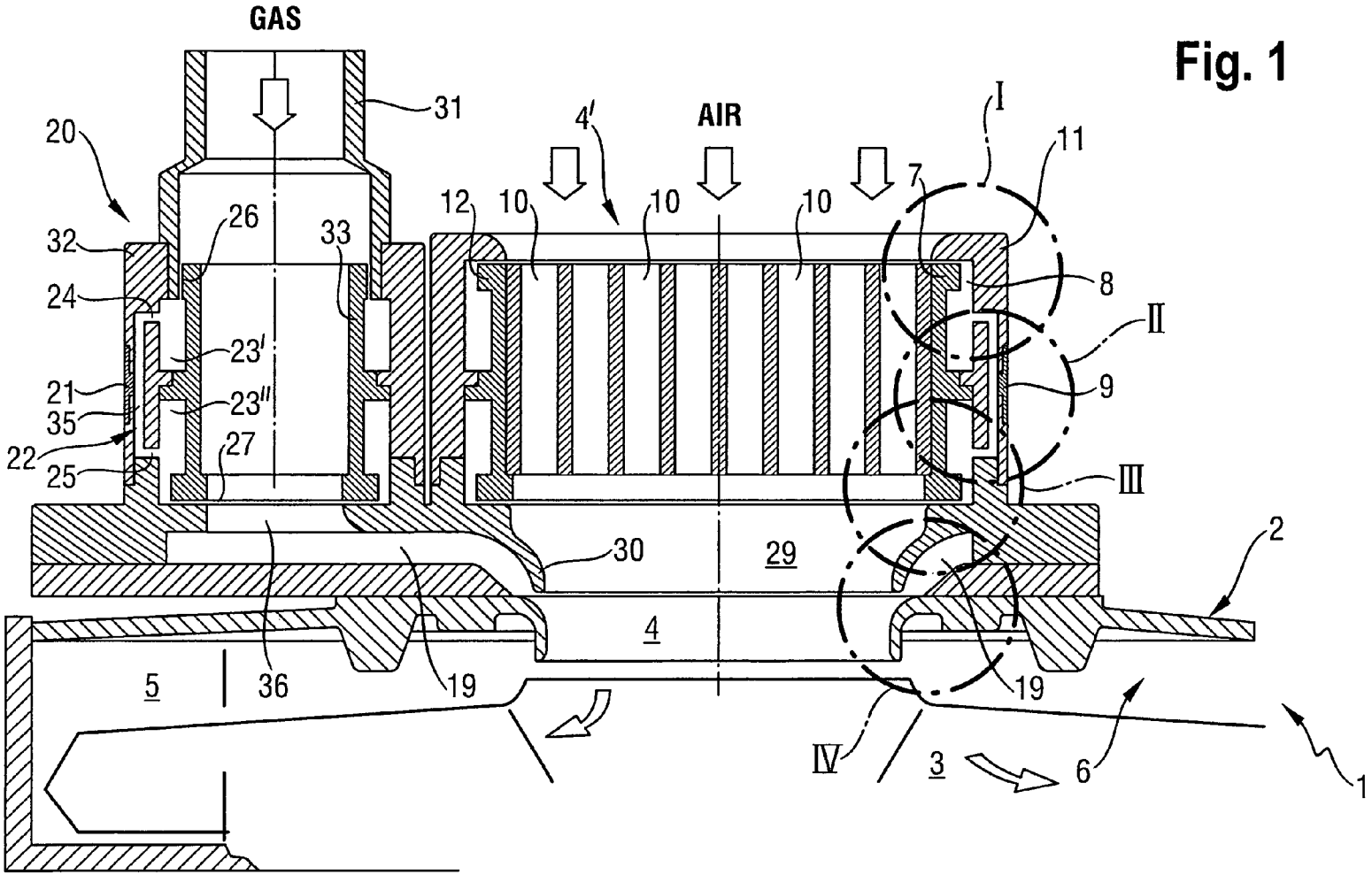

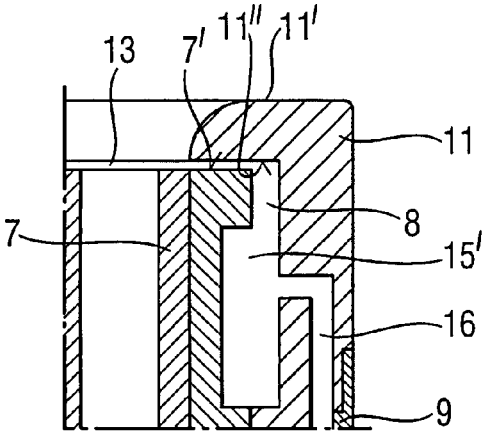
Fig. 2
Detail I
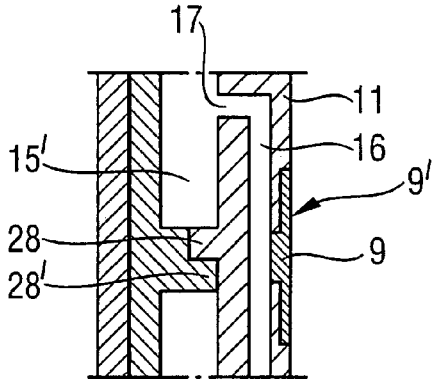
Fig. 3
Detail II
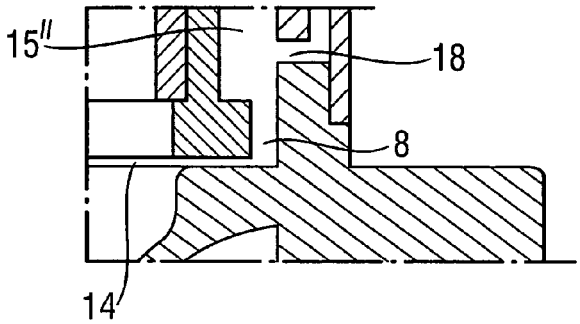
Fig. 4
Detail III
Fig. 5
Detail IV
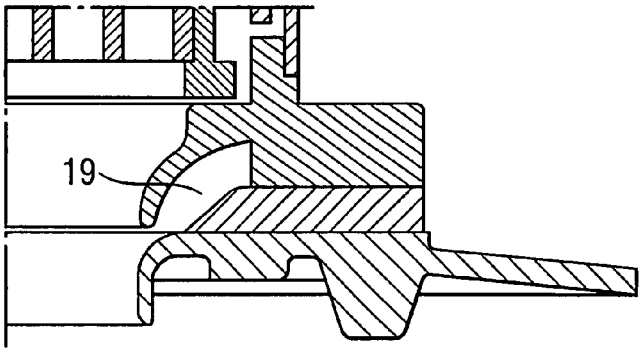
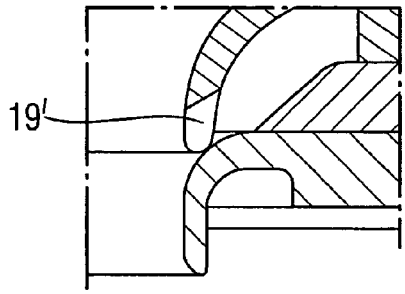
Fig. 8
Detail V Fig. 6
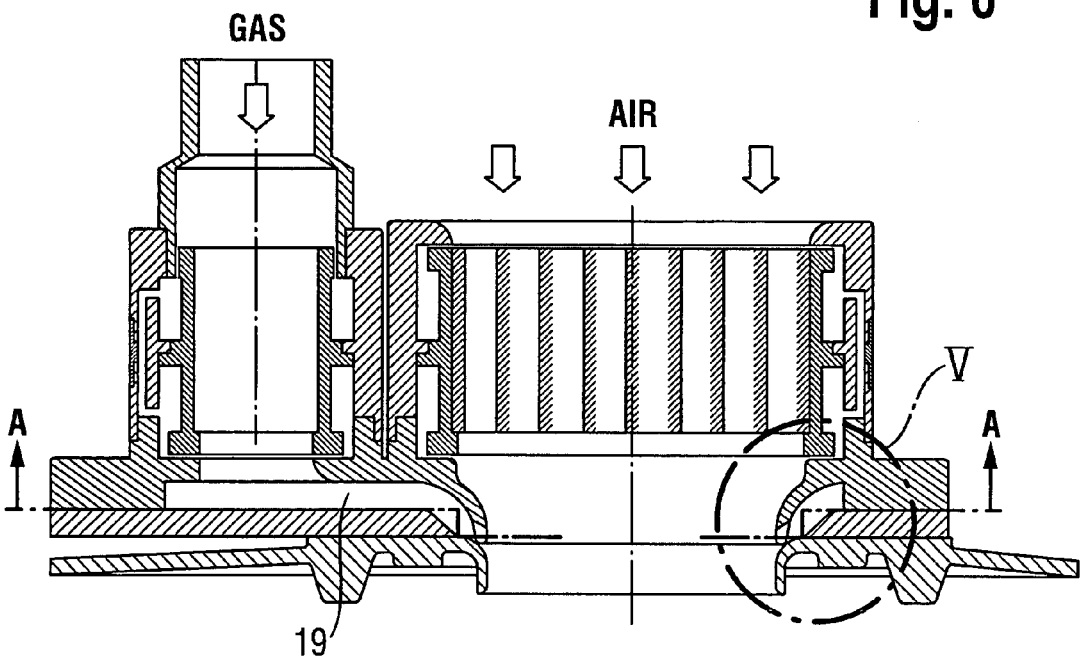
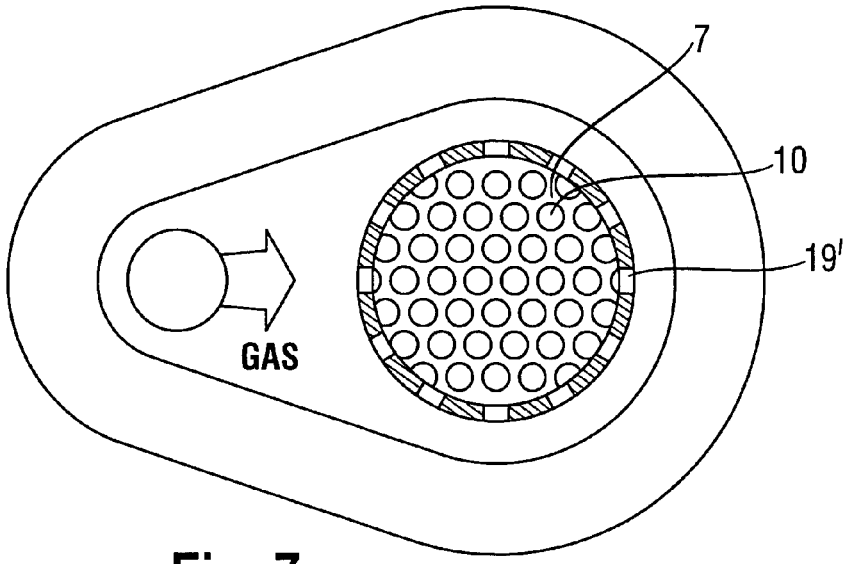
Fig. 7
SECTION A - A

FAN WITH LAMINAR FLOW ELEMENT IN FRONT OF THE SUCTION HOLE

The invention relates to a radial fan with a laminar flow element and a bypass. The radial fan has a housing and a fan impeller disposed therein, an air inlet and an air outlet, a pressure space being formed between the air inlet and the air outlet.

This type of radial fan is often used with burners for domestic technology. With this type of burner, it is essential, especially when the installation works according to the electronic combination principle, for the system parameters to be measured as accurately as possible in order to adapt the respective control precisely to the necessary requirement.

Normally, these types of burning installation are provided with a pneumatic combination, i.e. valves are controlled pneumatically, the control pressure being provided by the pressure produced by the fan impeller and being gauged at an appropriate point on the air inlet. Due to this it is essential that a minimum working pressure is always maintained in order to apply the required control forces. This means that a greater power input is required for a drive motor than would be necessary in order to provide just the desired heating power.

A substantial improvement is achieved if the control is provided according to the principle of electronic combination. With the electronic combination, the control commands for the respective valves are not relayed by pneumatic forces, but as electrical impulses to the valves. The electrical impulses to the valves are controlled by a computer unit. The respective control signals are dependent upon the power released, and this in turn can provide a revolution speed for the drive motor. The amount of fuel to be given is controlled dependent upon the air mass which is recorded by a suitable sensor. In the same way, the mass of fuel, in most cases gas, is recorded and added, controlled by computer, with regard to the quantity.

There is a problem, however, with the positioning of the sensors for measurement of the air masses and the gas quantities.

The object which forms the basis of the invention is to provide a radial fan of the type specified with which the most precise possible mass quantity measurement for a subsequent requirements-oriented control can be achieved in an inexpensive manner.

The object is fulfilled according to the invention in that in front of the air inlet a laminar flow element is disposed which, in a bypass formed therein, has a sensor for recording at least one parameter of the medium flowing through the air inlet. By disposing a laminar flow element in front of the air inlet it is guaranteed that the incoming flow is quasi laminar, independently of the revolution speed and other unit parameters. The special positioning of the sensor for recording a parameter of the medium flowing through the air inlet makes it possible to record the required parameters largely without any problems.

In an advantageous embodiment provision can be made such that the laminar flow element consists of an arrangement of flow channels which are surrounded by an outer cylinder. Advantageously, provision can be made here such that the flow channels are formed in one element which is inserted in the outer cylinder, the bypass being formed between the two components. In this way it is possible to process and produce the component in a simple manner.

A particularly advantageous embodiment can be seen in that the bypass has an access gap and a discharge gap which are each formed between the element and the outer cylinder. By forming gaps between two different components it is possible, in a simple manner, to adjust the volume flow through the bypass in relation to the volume flow in the main flow to the required level. By providing a gap as an inflow for the bypass, it is ensured that laminar flow is provided to the sensor so that highly accurate measurement results are achieved. In particular, provision can be made such that the access gap is in flow communication with an inflow opening of the tongue element, a settling chamber advantageously being provided behind the access gap in order to settle the air flow, and the sensor being disposed in a sensor channel and being in flow communication with the settling chamber by means of an inflow and an outflow opening. By means of this technical flow measure, a high level of settling is achieved for the medium to be measured, by means of which the quality of the measurement result is increased even further.

An inflow is formed between the laminar flow element and the air inlet of the housing for a further medium, this inflow advantageously being evenly distributed over the whole of the air inlet. By this means, the best possible mixing of the air and the burning medium is achieved.

The further medium is advantageously supplied via a feed element in which a sensor is also provided for gauging predetermined parameters. This sensor is also advantageously disposed in a bypass which extends between an element and an outer ring. The rest of the construction with settling chamber and flow communication of the bypass channel is of a similar form as in connection with the bypass in the laminar flow element.

In the following the invention is described in greater detail using examples of embodiments shown in the drawings.

They show as follows:

FIG. 1 a sectional view of a schematic representation of a part of a radial fan with housing, fan impeller, air inlet and feed element for further media, FIG. 2 a representation of detail I in FIG. 1, FIG. 3 a representation of detail II in FIG. 1, FIG. 4 a representation of detail III in FIG. 1, FIG. 5 a representation of detail IV in FIG. 1, FIG. 6 an alternative embodiment in the section according to FIG. 1, FIG. 7 a representation of a section along line A-A in FIG. 6, and FIG. 8 a representation of detail V in FIG. 6.

FIG. 1 shows an axial section through the air inlet region of a radial fan 1 according to a first embodiment. The radial fan 1 has a housing 2 with a fan impeller 3 disposed therein. In the schematic representation, an air inlet 4 disposed substantially centrally on a side wall of the housing 2 and, represented schematically, an air outlet 5 for the radial release of a medium mixture are illustrated.

A pressure space 6 extends between the air inlet 4 and the air outlet 5, and in said pressure space 6 the fan impeller 3 increases the pressure and the speed of the medium which flows through.

The air inlet 4 is provided with an intake curve in the conventional manner. A laminar flow element 7 is disposed in front of the air inlet 4. The laminar flow element has an arrangement of flow channels 10 which are formed by a plurality of passages formed in the laminar flow element 7. These passages can be circular, but can also have any other suitable cross-sectional form.

In the example of an embodiment shown, the flow channels 10 can be formed in an element 12 which is inserted into an outer cylinder 11. For this, the outer cylinder has a circumferential inner rib 28 on which the element 12 with a shoulder 28' rests.

A bypass 8 is formed between the inflow opening 4' of the laminar flow element and the outflow region 29 of the laminar flow element. A sensor 9 is provided along this bypass 8 by means of which the desired parameter of the medium flowing through the bypass is gauged as a reference value for medium passing through the laminar flow element.

According to the invention, the bypass is of a design which leads to particular settling of the medium flow, in particular in the region of the sensor.

In the example of an embodiment shown, in the direction of flow the bypass is formed by an access gap 13, a first settling chamber 15', an inflow opening 17, a sensor channel 16, an outflow opening 18, a second settling chamber 15" and a discharge gap 14.

In FIGS. 2 to 5, details I to IV of FIG. 1 are reproduced, enlarged. Detail 1 shows the entry region of the bypass 8. On its upper free end the outer cylinder 11 has an inwardly pointing shoulder 11' which extends over the whole area. The laminar flow element 7 is not adjoined, abutted against the shoulder 11' of the outer cylinder 11, but with its upper face surface 7' and the opposite surface 11" of the shoulder 11' forms a circumferential annular gap which, as the flow path extends towards the settling chamber 15' is extended. In the example of an embodiment shown, in its upper region the sensor channel 16 branches off from the settling chamber 15' at an inflow opening 17. In the lower region of the sensor channel 16 a settling chamber 15" is formed in turn which is in flow communication with the sensor channel 16 by means of the outflow opening 18. The settling chamber 15' in turn is in flow communication with the air passage in the outflow region 29 of the laminar flow element by means of the discharge gap 14. Directly adjacent to the discharge gap 14, the outflow region 29 narrows to a tip 30. This tip 30 reduces the cross section of the outflow region to the cross section of the air inlet 4.

The sensor 9 is disposed at an appropriate point in the sensor channel 16. The sensor 9 can be set so as to gauge different parameters of the medium which flows past, such as for example temperature and flow speed.

By means of the direct proximity of the discharge gap 14 to the tip 30 in the outflow region it is guaranteed as a result of the change in pressure that a continuous flow is maintained in the bypass.

As can be seen in FIG. 3, the sensor 9 is disposed on an element 9' which is inserted into a corresponding recess in the outer cylinder 11. The recess in turn opens towards the sensor channel so that the sensor can come into direct contact with the flowing medium.

As can also be seen from FIG. 1, the tip 30 ends at a predetermined distance in front of the air inlet 4 of the housing 3. Between the tip 30 and the air inlet 4 a circumferential annular gap is provided which is in flow communication with a feed element 20 for a further medium by means of an inflow channel 19. The gap formed between the wall of the tip 30 and the air inlet 4 is preferably wider on the side facing away from the feed element 20 than on the side facing towards the feed element. By means of this type of design it is guaranteed that the additional medium is supplied to the first medium with even distribution over the whole of the air inlet 4.

The additional medium, in this case fuel gas, is supplied via a feed element 20. The feed element 20 has an attachment 31 for a gas pipe. This attachment is in flow communication with a cylinder ring 32 into which an inner ring 33 is inserted. The feed element 20 is also equipped with a sensor 21 which is disposed in a bypass 22. The bypass construction essentially corresponds to the design which was described in connection with the laminar flow element 7. The bypass 22 therefore consists essentially of an access gap 26 which is located in the region of the transition between the attachment 31 for the gas pipe and the inner ring 33. An upper settling chamber 23' adjoins the access gap 26, and in the upper region an inflow opening 24 for the sensor channel 35 adjoins said settling chamber 23'. In its lower region the sensor channel 35 is in flow communication with the lower settling chamber 23" by means of an outflow 25. The lower settling chamber 23" is in flow communication with the outflow opening 36 by means of the discharge gap 27. The outflow opening 36 passes into the inflow channel 19 which guides the second medium to the air inlet 4 of the housing in the manner described above.

In FIG. 6 a further embodiment of the laminar flow element according to the invention is shown. With this design variation the inflow channel 19 of the further medium does not disembogue via an annular gap widening and narrowing again evenly around the circumference, but via a plurality of openings 19' into the region of the air inlet 4 or the tip region of the air inlet. The openings 19' are evenly distributed around the circumference, but have a larger passage cross-section as the distance from the feed element 20 increases. In this way it can also be guaranteed that an even mass flow of gas is supplied to the pressure space over the whole of the air inlet 4.

The invention is not restricted to the embodiments shown and described. For example, in the example of an embodiment shown, only one sensor is provided, but in order to make more accurate readings, several sensors can be disposed, distributed over the whole laminar flow element, the measurement results of which are correspondingly analysed in a computer, and the inflow of gas is correspondingly regulated.

The invention claimed is:

1. A radial fan with a housing and a fan impeller disposed within the housing, an air inlet of the housing and an air outlet of the housing, a pressure space being formed between the air inlet and the air outlet, wherein in front of the air inlet a laminar element is disposed which, in a bypass formed therein, comprises a sensor for recording at least one parameter of medium flowing through the air inlet.

2. The radial fan according to claim 1, wherein the laminar element consists of an arrangement of flow channels which are surrounded by an outer cylinder.

3. The radial fan according to claim 2, wherein the flow channels are formed in one element which is inserted in the outer cylinder, the bypass being formed between the one element and the outer cylinder.

4. The radial fan according to claim 3, wherein the bypass has an access gap and a discharge gap which are each formed between the one element and the outer cylinder.

5. The radial fan according to claim 4, wherein the access gap and the discharge gap are in flow communication with an inflow opening of the laminar element and an outflow region of the laminar element.

6. The radial fan according to claim 4, wherein behind the access gap, the bypass has a settling chamber for settling the air flow.

7. The radial fan according to claim 5, wherein the sensor is disposed in/on a sensor channel which is in flow communication with a settling chamber by means of an inflow opening of the settling chamber and an outflow opening of the settling chamber.

8. The radial fan according to claim 1, wherein an inflow channel for a further medium is formed between the laminar element and the air inlet of the housing.

9. The radial fan according to claim 8, wherein the further medium flows in, evenly distributed over the whole of the air inlet of the housing.

10. The radial fan according to claim 8, wherein the further medium is supplied via a feed element.

11. The radial fan according to claim 10, wherein the feed element has a sensor for the further medium.

12. The radial fan according to claim 11, wherein the sensor for the further medium is disposed in a bypass which has a settling chamber.

13. The radial fan according to claim 12, wherein the sensor for the further medium is disposed in a sensor channel which is in flow communication with the settling chamber by means of an inflow and an outflow.

* * * * *